US008424694B2

(12) United States Patent
Eustace

(10) Patent No.: US 8,424,694 B2
(45) Date of Patent: Apr. 23, 2013

(54) REDUCED WEIGHT STORAGE RACK

(76) Inventor: Brian Eustace, Sierra Madre, CA (US)

( * ) Notice: Subject to any disclaimer, the term of this patent is extended or adjusted under 35 U.S.C. 154(b) by 356 days.

(21) Appl. No.: 12/572,928

(22) Filed: Oct. 2, 2009

(65) Prior Publication Data

US 2010/0084354 A1 Apr. 8, 2010

Related U.S. Application Data

(60) Provisional application No. 61/102,788, filed on Oct. 3, 2008.

(51) Int. Cl.
*A47B 43/00* (2006.01)

(52) U.S. Cl.
USPC ..... 211/192

(58) Field of Classification Search ..... 211/192, 211/191, 134, 183, 87.01; 52/39, 506.06, 52/764, 506.01, 506.07; 248/340; 108/42, 108/149, 186, 57.14
See application file for complete search history.

(56) References Cited

U.S. PATENT DOCUMENTS

| | | | | | |
|---|---|---|---|---|---|
| 2,257,001 | A * | 9/1941 | Davis | 52/601 |
| 3,158,132 | A * | 11/1964 | Guthrie | 116/173 |
| 3,240,167 | A * | 3/1966 | De Podesta et al. | 410/26 |
| 3,280,530 | A * | 10/1966 | Rothenbach | 52/838 |
| 3,523,612 | A * | 8/1970 | Hall | 211/191 |
| 3,565,264 | A * | 2/1971 | Guiher | 211/117 |
| 3,874,035 | A * | 4/1975 | Schuplin | 248/72 |
| 4,109,440 | A * | 8/1978 | Bill | 52/839 |
| 4,461,134 | A * | 7/1984 | Lowe | 52/846 |
| 4,490,958 | A * | 1/1985 | Lowe | 52/634 |
| 4,551,882 | A * | 11/1985 | Swersey et al. | 16/226 |
| 5,063,721 | A * | 11/1991 | Larsson | 52/379 |
| 5,832,691 | A * | 11/1998 | Callahan et al. | 52/481.1 |
| 6,415,581 | B1 * | 7/2002 | Shipman et al. | 52/798.1 |
| 7,543,538 | B2 * | 6/2009 | Baez | 108/42 |
| 8,061,100 | B2 * | 11/2011 | Peleg | 52/531 |
| 2005/0210825 | A1 * | 9/2005 | Peleg | 52/748.1 |
| 2007/0175115 | A1 * | 8/2007 | Price | 52/169.12 |
| 2008/0283702 | A1 * | 11/2008 | Ikerd | 248/228.1 |
| 2010/0223871 | A1 * | 9/2010 | Peleg | 52/309.1 |
| 2010/0276558 | A1 * | 11/2010 | Faust et al. | 248/222.14 |
| 2010/0307991 | A1 * | 12/2010 | Belikoff et al. | 211/41.17 |

* cited by examiner

*Primary Examiner* — Jennifer E. Novosad
(74) *Attorney, Agent, or Firm* — Christie, Parker & Hale, LLP

(57) ABSTRACT

A lightweight cross-beam for a storage rack made of a single sheet of steel with a Z-style cross sectional configuration includes a generally vertical upper wall with upper and lower edges; a generally horizontal support wall extending inwardly from the lower edge of the upper wall; an angled intermediate wall extending downwardly and outwardly from the inner edge of the generally horizontal wall; and a generally vertical lower wall that extends downwardly from the outer edge of the angled wall. The angle between the generally horizontal support wall and the angled wall is about 60°. The upper and lower walls are generally in the same vertical plane. Upper and lower rivets extend outwardly from the upper and lower walls at each end of the cross-beam. The vertical distance between the upper and lower rivets is 3 inches. The length of the cross-beam is at least about 96 inches.

3 Claims, 8 Drawing Sheets

60"
96 1/2"
24 1/2"
200
3
1
2

2
40

5
2
40
3

REDUCED WEIGHT STORAGE RACK

CROSS-REFERENCE TO RELATED PATENT APPLICATION

The application claims priority to and the benefit of U.S. Patent Application No. 61/102,788, filed on Oct. 3, 2008, in the United States Patent and Trademark Office, the entire content of which is incorporated herein by reference.

FIELD OF THE INVENTION

The invention relates to a light weight storage rack capable of supporting high shelf loads by means of cross-beams having an improved "Z-style" cross-sectional design.

BACKGROUND OF THE INVENTION

A variety of storage racks have been designed to store tools, equipment, merchandise, and other items. Certain storage racks comprise horizontal shelf panels that are supported by a frame which, in turn, is supported by generally vertical corner support posts. Each shelf frame is formed by front and rear cross-beams and side beams which are attached at their ends to the corner support posts. A solid panel, e.g., particle board, metal panel, or the like is mounted on or within the frame.

Large storage racks having a span or width of 96 inches or greater and which can handle heavy loads, e.g., 3,000 pounds or more typically have cross-beams with added clips or flanges with inwardly extending lances that engage wedge-shaped slots in corner support posts. Such cross-beams are expensive to manufacture and tend to be heavy, resulting in increased shipping costs. Such a cross-beam design is shown, for example, in U.S. Patent Application Ser. No. 61/050,992, the disclosure of which is incorporated herein by reference. U.S. patent application Ser. No. 11/854,500, the disclosure of which is incorporated herein by reference, describes certain storage racks having shelves about 48 inches long and about 18 inches wide can support 1500 pounds per shelf. These racks have corner posts 1, with a standard boltless post design as shown in FIG. 1. The posts are Cold Roll steel and typically 20-gauge. As shown in FIGS. 2*a*-2*c*, cross-beams 2 have a "Z-style" cross sectional configuration and are made of 16-gauge Hot Rolled (P&O) steel according to ASTM A1011-CS Type B (Rockwell Hardness of 75 or less) or Cold Roll steel or ASTM A1008 commercial steel. With particular reference to FIG. 2*c*, these Z-style cross-beams include a generally vertical upper wall 12, a generally horizontal support wall 14 extending inwardly from the lower edge of the upper wall, an angled intermediate wall 16 that extends downwardly and outwardly from the inner edge of the generally horizontal wall and a lower wall 18 that extends it downwardly from the outer edge of the angled wall. The cross-beam is made of a single sheet of steel folded into the indicated cross-sectional configuration which has an overall width of 2 3/32 inches. The width of the upper wall 12 is about 9/16 inch. The width of the horizontal wall 14 is 9/16 inch, the width of the angled intermediate wall 16 is about 27/32 inch. The angle of the intermediate wall 16 to the horizontal wall 14 is about 54°. The width of the lower wall 18 is about 17/32 inch. The lower wall 18 is generally vertical and lies in generally the same plane as that of the upper wall 12. At each end of the cross-beam, a rivet 30 extends outwardly from the upper wall 12 and a rivet 32 extends outwardly from the lower wall 18.

In one known storage rack, the length of the front and rear cross-beams is about 48 inches and the length of the side cross-beams is about 18 inches. The cross-beams 2 have the Z-styled cross-sectional configuration as described above and are attached at their ends by boltless connections, i.e., rivets 30, 32 extending from the ends of the cross-beams 2 into keyhole slots 3 in upright corner support posts 1, and are seated in those slots 3. The corner support posts 1, 1A may be of the standard type shown in FIG. 1 or, as show in FIGS. 2*a* and 2*b*, may have concealed slots 3.

The cross-beams 2 are arranged to form frames for a shelf panel, preferably made of 5/8 inch thick (or 1/2 or 10 mm or 16 mm) particle board or the like. Each panel is made of commercial grade particle board having a density of about 40-45 pounds per cubic foot ("lb./cf") and preferably about 42 lb./cf. In this arrangement, each shelf is capable of supporting a weight of 1,500 pounds as measured according to ANSI MH28.1-1977, modified as described below. ANSI Standard MH28.1-1977 states:

6.2 Determination by Test 6.2.1 The location of test loads along the shelf and perpendicular to it shall simulate uniformly distributed loading. End connections (clips, rivets) shall be those used in the finished sections.

For testing purposes, the section shall consist of two upright assemblies not bolted to floor. A test shelf shall be installed and fully seated into the section, and additional shelves may be installed above and below the test shelf, as required, for section stability. Weight of (not to exceed) 25 lbs increments is equally spaced on test shelf with a minimum gap of 1/4" in between to prevent a bridging effect.

6.2.2 After proper installation, preload shelf to 50 lbs to set clips and structure. Remove load and set gauges to zero. An initial uniform load equal to 50% of expected rated uniform design load or 50% of allowable deflection (SPAN/140) shall be applied. Loads or deflections shall then be increased in maximum increments of one-tenth of the expected failure load or deflection.

6.2.3 The allowable rated uniform load derived from test results shall be the smallest of the following:

(a) Two-thirds (factor of safety of 1.5) of the ultimate average failure load carried by the shelf.

(b) Eight-tenths (factor of safety of 1.25) of the average load at which the load deflection curve becomes nonlinear (yield point).

(c) The load at which the maximum vertical deflection (width or depth), including deformations in end connections, equals the effective shelf width or depth (span) divided by 140, measured at the center of the edge with respect to the position of the same point of the shelf at the beginning of the test.

(d) Four times the capacity of the shelf connection as defined in section 8.2.1 (factor of safety of 2).

6.3 Test data evaluation 6.3.1 Where practicable, evaluation of the test results shall be made on the basis of the average values resulting from tests of not fewer than three identical specimens, provided the deviation of any individual test result from the mean value does not exceed ±10%. If such deviation from the mean value does exceed 10%, at least three more tests of the same design shall be made. The average of all tests shall then be regarded as the result of the series of tests and used as the value from which the rated uniform load is derived.

6.3.2 Once the rated uniform load has been determined as specified above, the following additional tests shall be made using a properly installed new set of specimens. An initial load of 50% of the design load shall be applied to the shelf. Return to 5% of the designed load and set dial indicators at zero. Apply 125% of design load and hold for 15 minutes. Return to 5% design load and take readings. The maximum permanent set must be equal to or less than 0.15 L/140.

The shelf load of the storage rack having the Z-style cross-beams of U.S. patent application Ser. No. 11/854,500 was tested as described in ANSI MH28.1-1977 over a 24 hour period. Initially, 100 pounds (from 25 pound bags of lead shot) were distributed evenly by hand over the shelf. Then, every two hours 100 pounds (four 25-pound bags of lead shot) is added to about half of expected capacity, e.g., 1500 pounds. A dial meter was placed under the shelf to measure deflection. The load, i.e., about half of expected capacity, was allowed to sit on the shelf for 35-40 minutes. Then, 100 pound increments (from 25-pound bags of lead shot) were added up to the capacity, i.e., when the allowable deflection (SPAN/140) has been met. The load was then allowed to remain on the shelf an additional 24 hours to assure that no failure occurred during that period.

SUMMARY OF THE INVENTION

The present invention is an improved Z-style cross-beam that enables the construction of a 96 inch wide storage having load capacity of 2,000 lbs with 16-gauge cross-beams and 3,000 lbs with 14-gauge cross-beams. The invention further comprises boltless storage racks assembled using the improved Z-style cross-beam. A storage rack 96 inches wide and 24 inches deep is able to support the 3,000 pounds per shelf for a 14-gauge beam, and 2,000 pounds per shelf for a 16-gauge beam.

BRIEF DESCRIPTION OF THE DRAWINGS

FIGS. 11*a*-11*e* are views of a tie support according to an embodiment of the present invention.

DETAILED DESCRIPTION OF THE INVENTION

Figure 1:
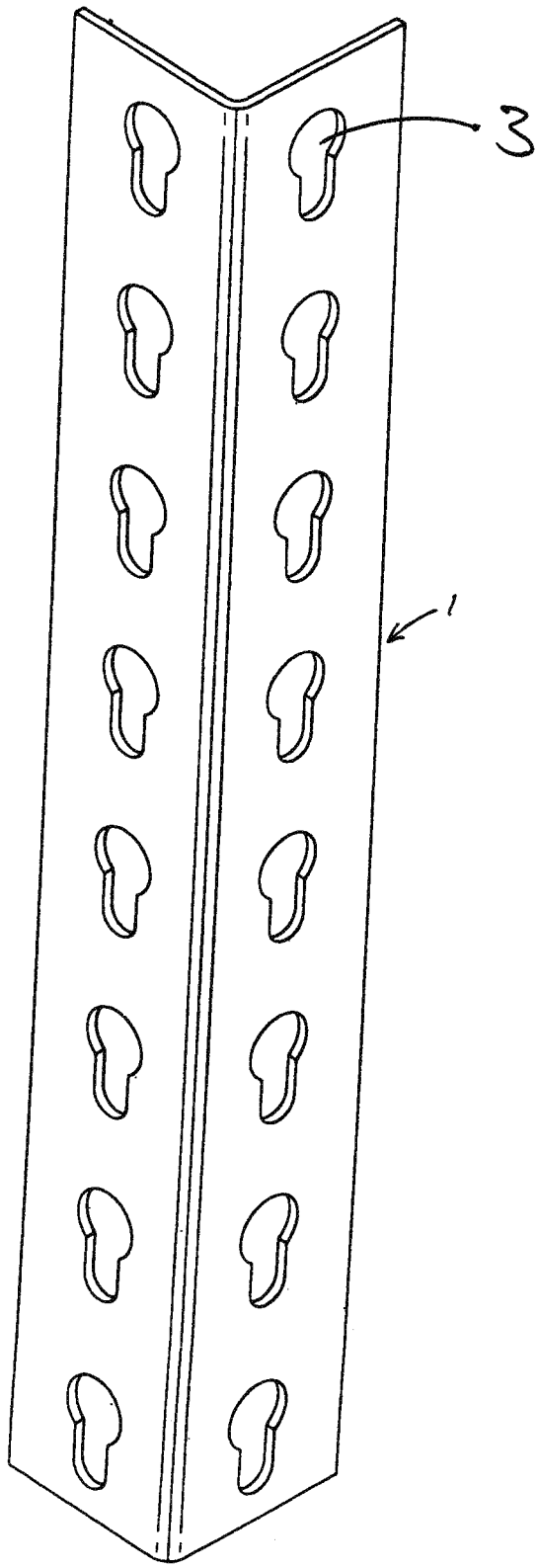
FIG. 1 is a perspective view of a boltless support post.
Figure 2B:
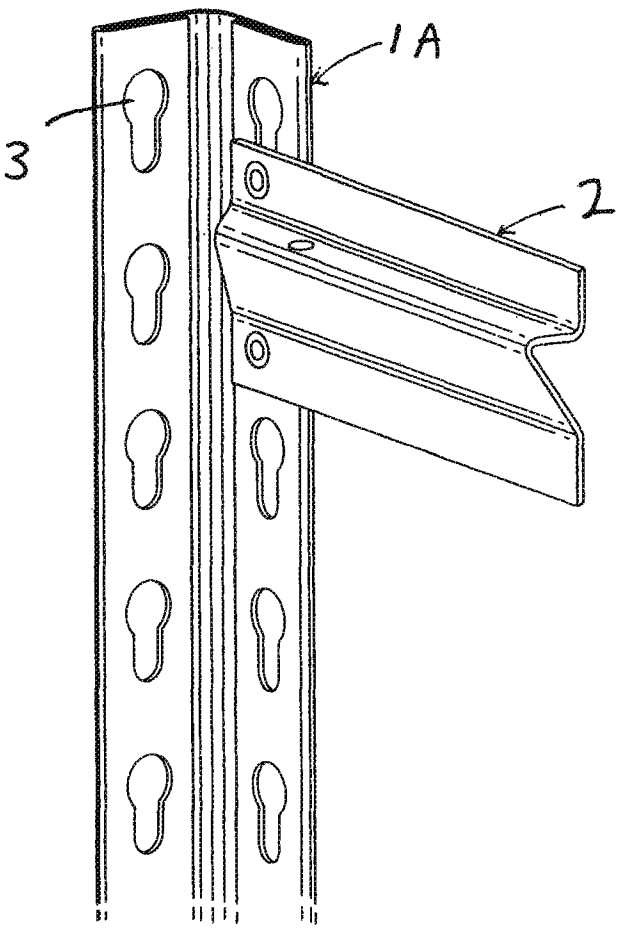
FIGS. 2*a* and 2*b* are perspective views showing a boltless attachment of a cross-beam.
Figure 2A:
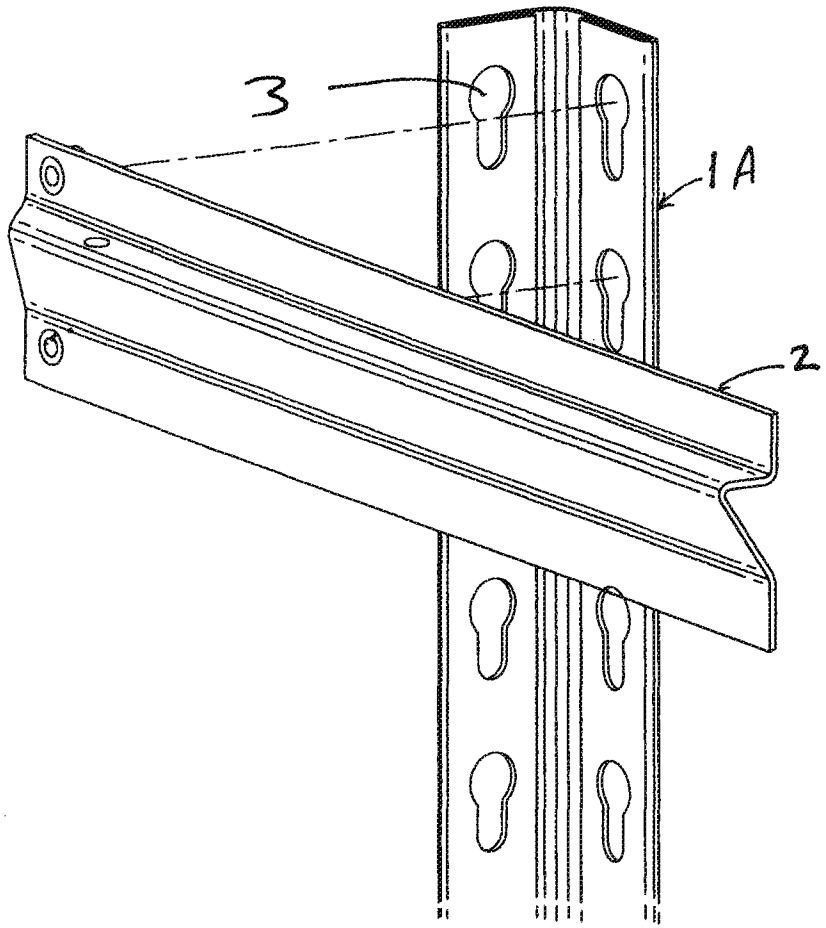
Figure 2C:
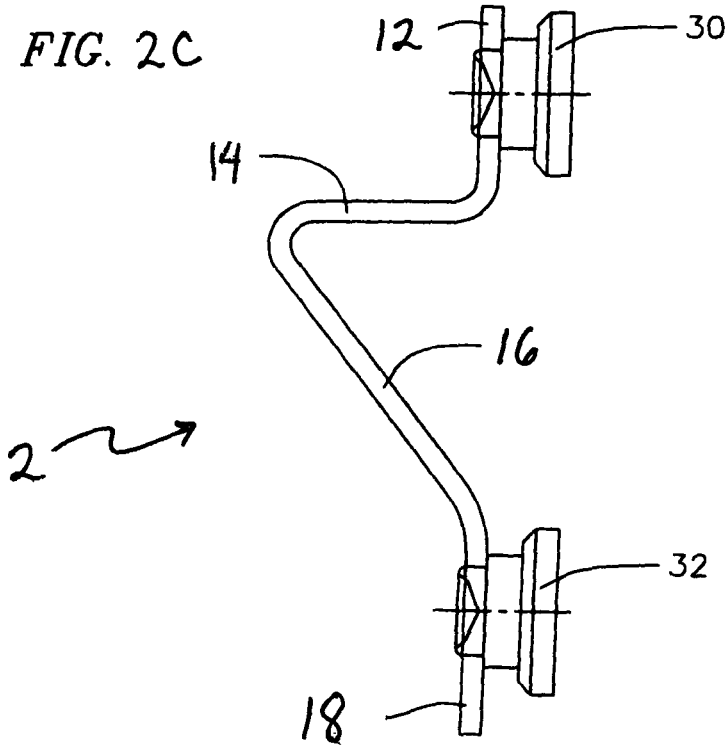
FIG. 2*c* is a cross-sectional view of a Z-styled cross-beam.

In one aspect of the invention shown in FIGS. 5-9, there is provided a light weight cross-beam for use in the construction of high load storage racks. The cross-beams have an improved Z-style cross-sectional configuration and have a thickness of 16-gauge (for 2,000 lb. capacity). The improved Z-style cross sectional configuration includes a generally vertical upper wall 22, a generally horizontal support wall 24 extending inwardly from the lower edge of the upper wall, an angled wall intermediate 26 that extends downwardly and outwardly from the inner edge of the generally horizontal wall 24, a vertical lower wall 28 that extends downwardly from the outer edge of the angled wall, a horizontal bottom wall 30 that extends inwardly from the lower edge of the vertical lower wall 28, and an vertical inner wall that extends upwardly from the inner edge of the bottom wall 30. The width of the upper wall 22 is about 9/16 inch. The width of the horizontal wall 24 is about 1¼ inch, the width of the flat portion of the angled intermediate wall is about 2 7/16 inches. The angle of the intermediate wall 26 to the horizontal wall 24 is about 60°. The width of the lower wall 28 is about 25/32 inch. The lower wall 28 is generally vertical and generally lies in about the same plane as that of the upper wall. The width of the bottom wall 30 is about 1¼ inches. The width of the inner wall 32 is about 13/32 inch. The overall width of the cross-beam is about 3⅝ inch. The dimensions may vary slightly, although it is preferred that the overall width does not vary more than about ⅛ inch.

It is preferred that the length of the 16-gauge cross-beam not exceed about 96 inches for load capacity of 2,000 pounds. Cross-beams having greater lengths may be used for lesser load capacities.

In another embodiment of the present invention, the cross-beam has the same dimensions described above and has a thickness of about 14 gauge. In this embodiment of the present invention, the length of the 14-gauge cross-beam does not exceed 96 inches for load capacities of 3,000 pounds.

With reference to FIGS. 5-8, the ends of the cross-beams preferably carry upper and lower rivets 30 and 32 which extend outwardly from the upper wall 22 and lower wall 28, respectively for boltless connection to a support post 1. The distance between the centers of the upper and lower rivets 30 and 32 is about 3 inches. The rivets 30, 32 extend into the upper circular portion 104 of key hole shaped slots 102 in the support post 1 and are then seated into the lower, narrower portion 106 of the key hole slot 102. The slots are typically spaced apart by a vertical distance of 1.5 inches (from center point to center point.)

Figures 5, 6, 7, 8:
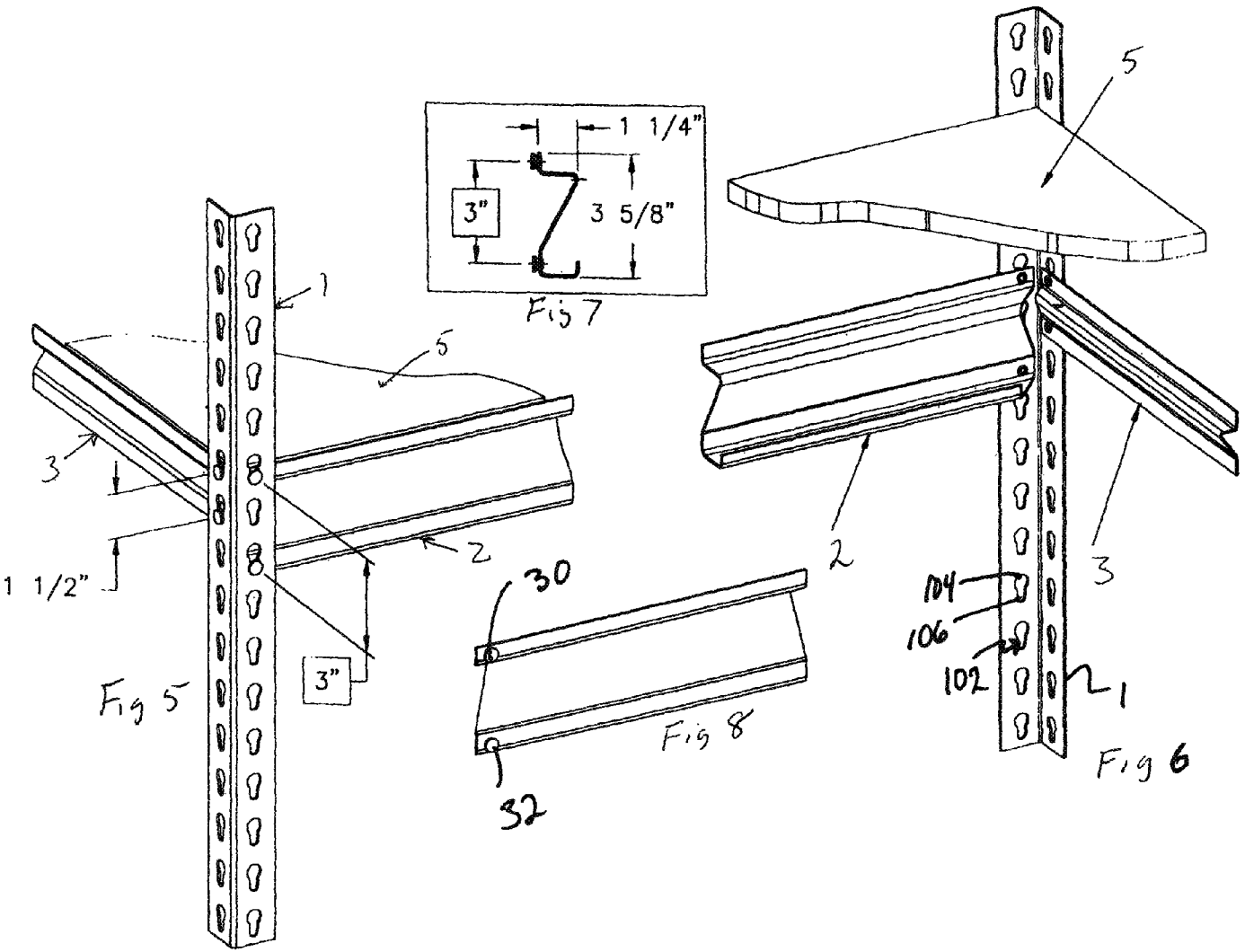
FIGS. 5 and 6 are perspective views showing the engagement of a cross-beam to a support post according an embodiment of to the present invention.
FIG. 7 is a cross-sectional view of the end of a cross-beam according to an embodiment of the present invention.
FIG. 8 is a perspective view of the end of a cross-beam according to an embodiment of the present invention.
Figure 9:
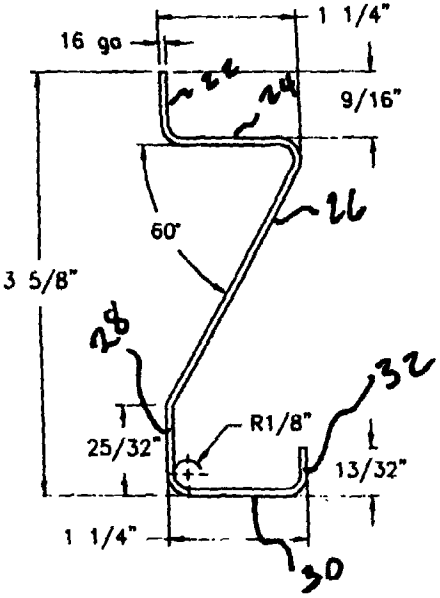
FIG. 9 is a cross-sectional view of a cross-beam according to the an embodiment of present invention.
Figure 11A:
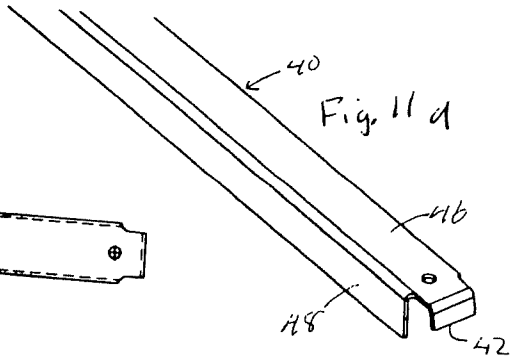
Figure 11B:
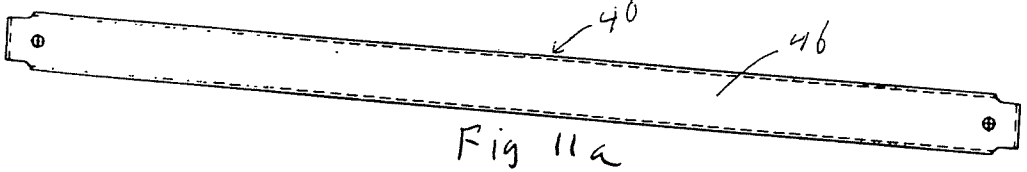
Figures 11B, 11C, 11E:
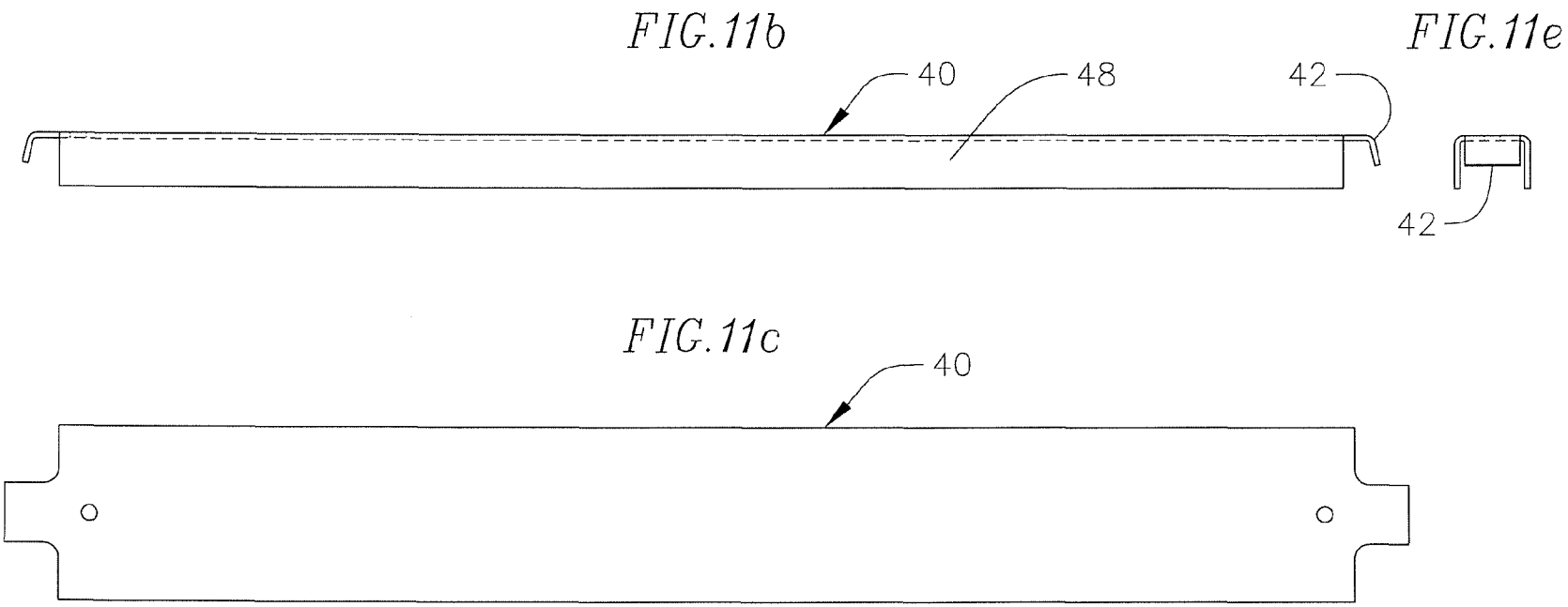

In another aspect of the invention shown, for example in FIGS. 5 and 6, there is provided a shelf frame comprising front and rear cross-beams 2 and a pair of side cross-beams 3 along with support posts 1 for connecting adjacent cross-beams for supporting a generally flat panel. Each of the front and rear cross-beams 2 and comprise the improved Z-style cross sectional configuration described above. The cross-beams 2 are designed for boltless construction and comprise outwardly extending rivets 30, 32, as described above. The side cross-beams 3 may be of the same construction as the front and rear cross-beams 2, or may be of the Z-style beams described in patent application Ser. No. 11/854,800 or any other suitable design. The support posts 1 comprise slots to receive the rivets.

In another aspect of the invention, the shelf frame is combined with a shelf panel 5 that fits closely within the frame and is supported along its perimeter by the horizontal walls of the cross-beams 2 and side cross-beams 3. A preferred shelf panel 5 is made of commercial grade particle board having a thickness of ⅝ inch and a density of 40-45 pounds per cubic foot ("lbs./cf"), most preferably about 42 lbs./cf. Alternatively, shelves made of plywood, wire panels or grates, molded plastic, formed metal sheets or any other suitable material can be used.

The shelf frame may comprise one or more tie supports 40 which extend from the front cross-beam to the rear cross-beam. The tie supports 40 comprise downwardly depending tabs 42 at their front and rear ends which are inserted into slots 44 in the horizontal wall 24 of the front and rear cross-beams 2. In the embodiment shown, the tie supports 40 have an inverted U-shape configuration with a top wall 46 and two side walls 48. It is understood that any suitable cross sectional configuration may be used as desired. The tie supports assist in supporting the shelf panels 5 and also assist in preventing or reducing rotation of the front and rear cross-beams 2 due to the downward pressure created by loads placed upon the shelves 5. The number of tie supports, if any, is a matter of choice and will typically depend on the strength and rigidity of the material of the shelf panel and the weight of the load carried on the shelf.

In another aspect of the invention, cross-beams 2 having the improved Z-style cross sectional configuration described above are combined with corner support posts and shelf panels to form a storage rack. The storage rack is preferably of boltless construction and may be stationary or movable on rollers if desired. The dimensions of the rack as well as the number and spacing of the shelves is not critical and is a matter of choice. A preferred rack has a width or span of 96 inches and a depth of 24 inches.

Figures 3, 4, 10:
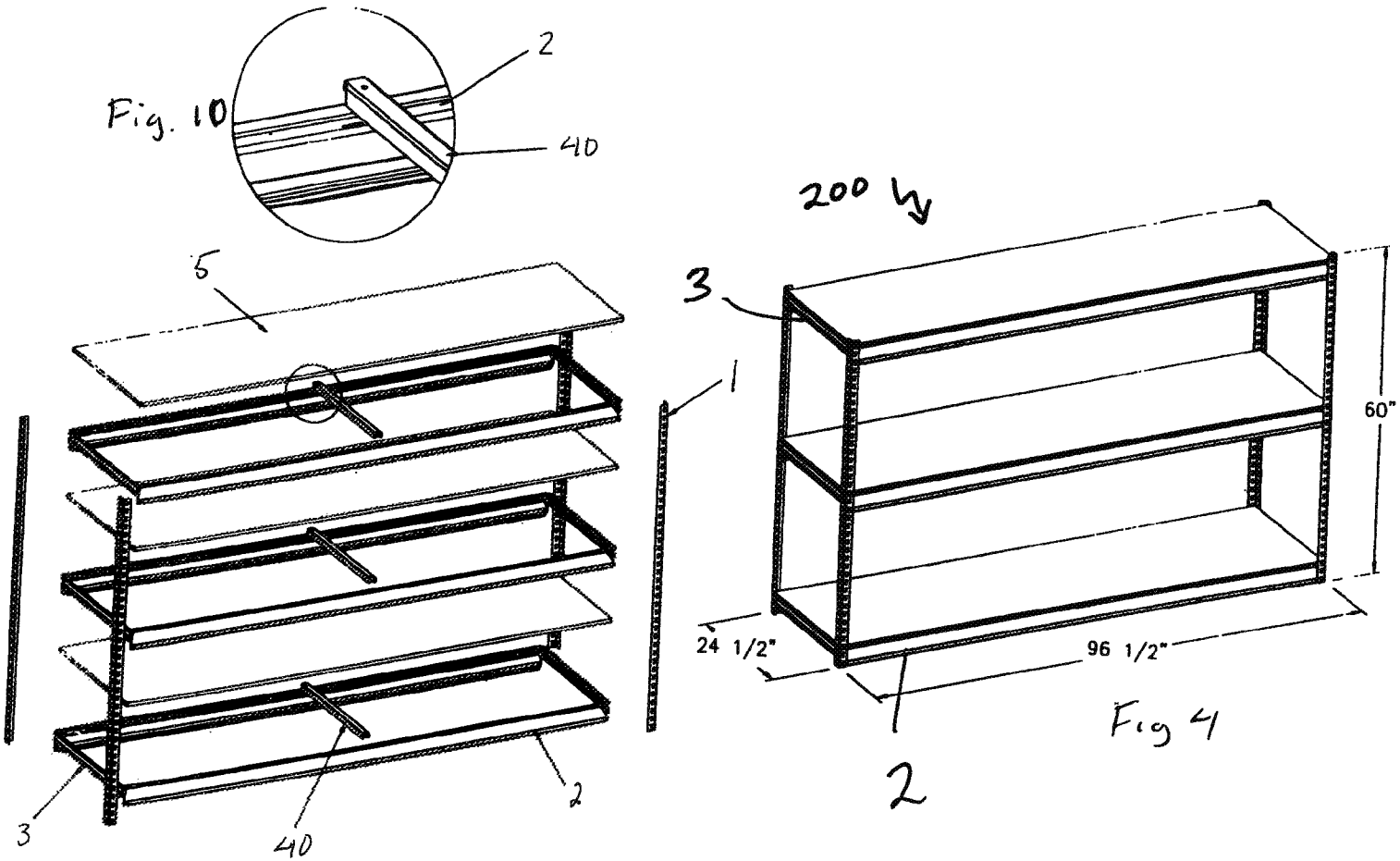
FIGS. 3 and 4 are perspective views of a boltless rack constructed with cross-beams according to an embodiment of the present invention.
FIG. 10 is an enlarged perspective view of a tie support and cross-beam attachment according to an embodiment of the present invention.

In another aspect of the invention as shown in FIG. 3, there is provided a storage rack 200. The storage rack 200 includes four corner support posts 1. Front and rear cross-beams 2 having an improved Z-style construction as described above extend horizontally between the front and rear corner support posts 1, respectively. Side cross-beams 3 extend between the front and rear support posts 1 on each side. The cross-beams 2, 3 are vertically spaced according to the desired space between shelves of the storage rack. The front and rear cross-beams 2 comprise a pair of rivets at each end and are anchored to the upright support posts 1 by passing the heads of the rivets through the large, generally circular, upper portion of keyhole slots in the corner support posts and lowering the cross-beam and rivets until the shaft of the rivets seat in the lower slot portions of the keyholes. In this arrangement, when the rivets are seated within the slot portion of keyhole, the end of the upper and lower walls of the cross-beam engage the inner surface of the support post and the heads of the rivet engages the outer surface of the support posts.

The shelf load of two storage racks having 96 inch front and rear Z-style cross-beams and 24 inch cross-beams having the design disclosed in U.S. patent application Ser. No. 11/854,500 was tested as described in ANSI MH28.1-1977 over a 24 hour period. The first storage rack had 16-gauge front and rear cross-beams and the second storage rack had 14-gauge front and rear cross-beams. In each test, 100 pounds (from 25 pound bags of lead shot) were initially distributed evenly by hand over the shelf. Then, every two hours 100 pounds (four 25-pound bags of lead shot) is added to about half of expected capacity, e.g., A dial meter was placed under the shelf to measure deflection. The load, i.e., about half of expected capacity, was allowed to sit on the shelf for 35-40 minutes. Then, 100 pound increments (from 25-pound bags of lead shot) were added up to the capacity, i.e., 2,000 pounds for the storage rack with 16-gauge front and rear cross-beams and 3,000 pounds for the storage rack with 14-gauge front and rear cross-beams. The allowable deflection (SPAN/140) under the ANSI MH28.1-1977 standard was not exceeded. The load was then allowed to remain on the shelf an additional 24 hours to assure that no failure occurred during that period.

It is understood that a variety of modifications can be made to the storage rack without departing from the scope of the invention. For example, while the thickness of the steel for 96-inch cross-beams is preferably 16 gauge for loads up to 2,000 lbs and 14 gauge for loads up to 3,000 lbs, lesser, or even greater thicknesses may be used, and still achieve the benefits of the invention, e.g., a lighter weight storage rack made of thinner steel or other frame material having the same support capacity as heavier prior art racks made with thicker steel cross-beams.

What is claimed is:

1. A lightweight cross beam for a storage rack having a length of at least about 96 inches and a Z-style cross sectional configuration comprising:

a generally vertical upper wall having upper and lower edges;

a generally horizontal support wall having inner and outer edges extending inwardly from the lower edge of the upper wall;

an angled intermediate wall having inner and outer edges that extends downwardly and outwardly from the inner edge of the generally horizontal wall;

a generally vertical lower wall having upper and lower edges that extends downwardly from the outer edge of the angled wall;

a generally horizontal bottom wall having inner and outer edges that extends inwardly from the lower edge of the lower wall; and a generally vertical inner wall that extends upwardly from the inner edge of the bottom wall, an upper and lower rivet extending outwardly from each of the generally vertical upper wall and lower wall respectively at each end of the cross beam, wherein the width of the upper wall is about 9/16 inch, the width of the generally horizontal support wall is about 1 1/4 inch, the angle between the generally horizontal support wall and the angled wall is about 60°, the upper and lower walls are generally in the same vertical plane, and the distance between the centers of the upper and lower rivets at each end of the cross beam is 3 inches, wherein the storage rack is configured to support up to approximately 2,000 pounds when the cross beam is made of a single sheet of steel having a thickness of no more than about 16 gauge, and wherein the storage rack is configured to support up to approximately 3,000 pounds when the cross beam is made of a single sheet of steel having a thickness of no more than about 14 gauge.

2. A storage rack shelf comprising:

front and rear cross-beams having a length of about 96 inches and a pair of side cross-beams having a length of about 24 inches and wherein each of front and rear cross-beams comprises a generally vertical upper wall having upper and lower edges;

a generally horizontal support wall having inner and outer edges extending inwardly from the lower edge of the upper wall;

an angled intermediate wall having inner and outer edges that extends downwardly and outwardly from the inner edge of the generally horizontal wall;

a generally vertical lower wall having upper and lower edges that extends downwardly from the outer edge of the angled wall;

a generally horizontal bottom wall having inner and outer edges that extends inwardly from the lower edge of the lower wall; and a generally vertical inner wall that extends upwardly from the inner edge of the bottom wall;

an upper and lower rivet extending outwardly from each of the generally vertical upper wall and lower wall respectively at each end of the cross-beam, wherein the width of the upper wall is about 9/16 inch, the width of the generally horizontal support wall is about 1 1/4 inch, the angle between the generally horizontal support wall and the angled wall is about 60° , the upper and lower walls are generally in the same vertical plane, and the distance between the centers of the upper and lower rivets at each end of the cross-beam is 3 inches; and a generally rectangular shelf panel having a length of about 96 inches and a width of about 24 inches supported on the generally horizontal walls of the front, rear and side cross-beams wherein the storage rack is configured to support up to approximately 2,000 pounds when the cross beam is made of a single sheet of steel having a thickness of no more than about 16 gauge, and wherein the storage rack is configured to support up to approximately 3,000 pounds when the cross beam is made of a single sheet of steel having a thickness of no more than about 14 gauge.

3. A storage rack comprising:

a pair of front support posts;

a pair of rear support posts;

at least one shelf comprising:

a front cross-beam extending between the front support posts, a rear cross-beam extending between the rear support posts a pair of side cross-beams extending between the front and rear support posts and wherein each of front and rear cross-beams comprises a generally vertical upper wall having upper and lower edges;

a generally horizontal support wall having inner and outer edges extending inwardly from the lower edge of the upper wall;

an angled intermediate wall having inner and outer edges that extends downwardly and outwardly from the inner edge of the generally horizontal wall;

a generally vertical lower wall having upper and lower edges that extends downwardly from the outer edge of the angled wall;

a generally horizontal bottom wall having inner and outer edges that extends inwardly from the lower edge of the lower wall; and a generally vertical inner wall that extends upwardly from the inner edge of the bottom wall;

an upper and lower rivet extending outwardly from each of the generally vertical upper wall and lower wall respectively at each end of the cross-beam, wherein the width of the upper wall is about 9/16 inch, the width of the generally horizontal support wall is about 1 1/4 inch, the angle between the generally horizontal support wall and the angled wall is about 60° , the upper and lower walls are generally in the same vertical plane, and the distance between the centers of the upper and lower rivets at each end of the cross-beam is 3 inches; and a generally rectangular shelf panel having a length of about 96 inches and a width of about 24 inches supported on the generally horizontal walls of the front, rear and side cross-beams wherein the storage rack is configured to support up to approximately 2,000 pounds when the cross beam is made of a single sheet of steel having a thickness of no more than about 16 gauge, and wherein the storage rack is configured to support up to approximately 3,000 pounds when the cross beam is made of a single sheet of steel having a thickness of no more than about 14 gauge.

* * * * *